United States Patent [19]

Minard

[11] Patent Number: 4,700,756

[45] Date of Patent: Oct. 20, 1987

[54] RELEASABLE RETAINING MEANS FOR FILLING MACHINE VALVES

[75] Inventor: Everett S. Minard, Sacramento, Calif.

[73] Assignee: Elmar Industries, Inc., Santa Clara, Calif.

[21] Appl. No.: 908,806

[22] Filed: Sep. 18, 1986

[51] Int. Cl.[4] ..... B65B 43/42; B67C 3/26

[52] U.S. Cl. ..... 141/144; 141/284; 141/367; 141/392; 239/550; 251/156; 285/137.1

[58] Field of Search ..... 141/392, 250–284, 141/387, 388, 389, 129–192, 382–386, 367, 368, 351; 138/106; 251/156, 143; 285/137.1; 239/550

[56] References Cited

U.S. PATENT DOCUMENTS 3,771,730 11/1973 Nicoloff et al. ..... 239/550
4,593,838 6/1986 Oberbach et al. ..... 141/367

FOREIGN PATENT DOCUMENTS 619492 10/1935 Fed. Rep. of Germany ..... 239/550

*Primary Examiner*—Houston S. Bell, Jr.
*Attorney, Agent, or Firm*—Theodore H. Lassagne

[57] ABSTRACT

A container filling machine is provided with easily demountable nozzles or valves capable of being clamped in position in openings through which fluid product passes from the reservoir to containers. Clamping assemblies, pivotable into engagement with flanges on the nozzles, are fixed to the machine between the nozzles and a single assembly either clamps two of the nozzles in operating position or frees them for removal.

9 Claims, 7 Drawing Figures

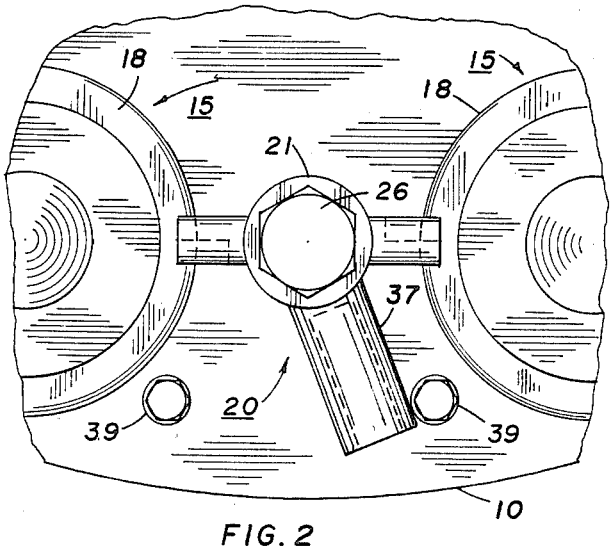
FIG. 2
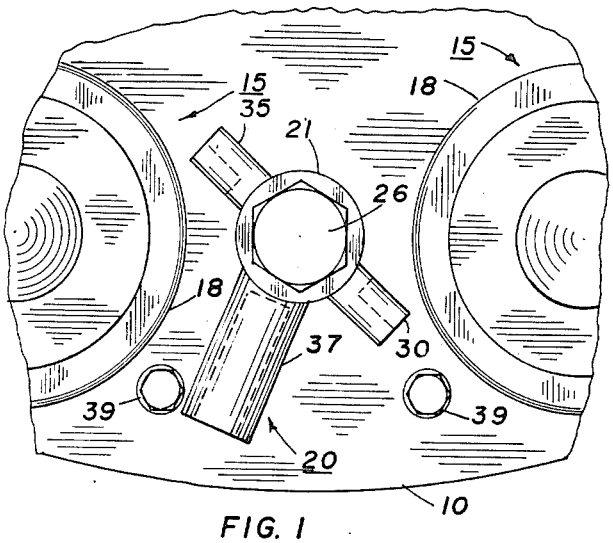
FIG. 1
FIG. 4
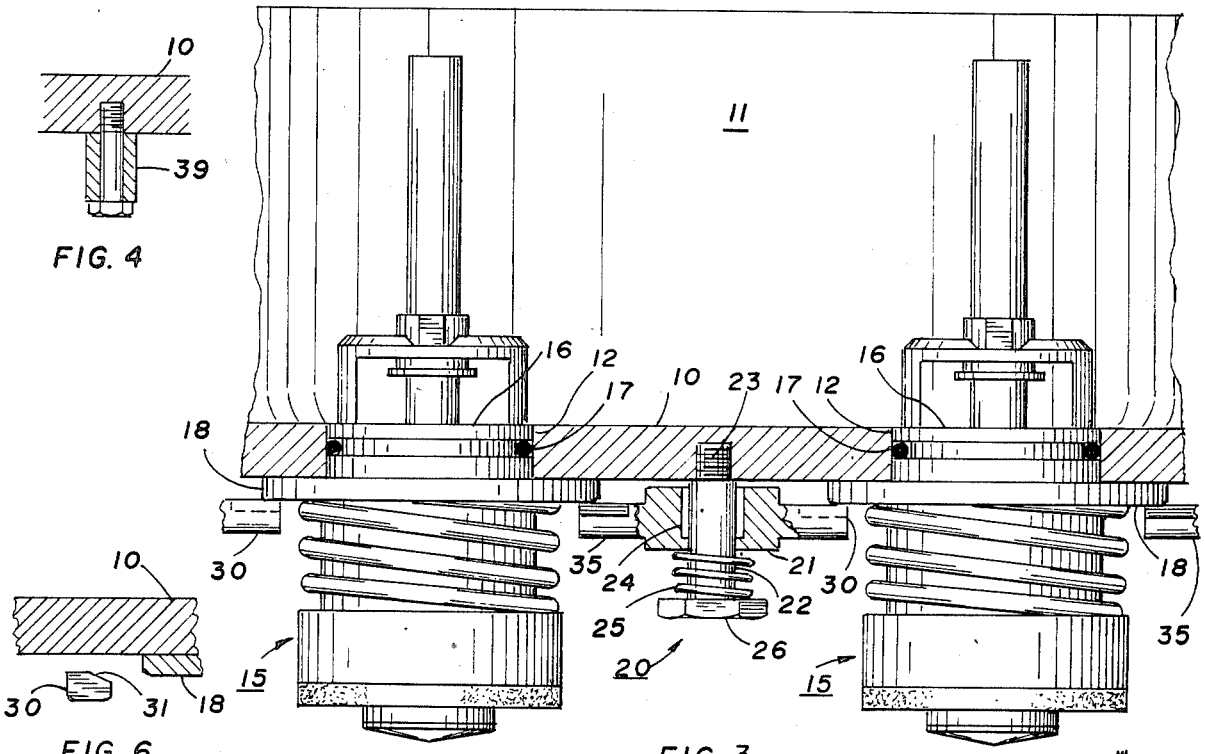
FIG. 6
FIG. 3
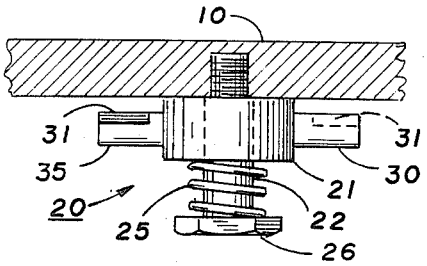
FIG. 5
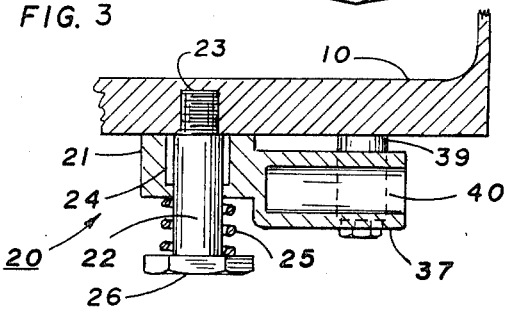
FIG. 7

RELEASABLE RETAINING MEANS FOR FILLING MACHINE VALVES

The present invention relates to improvements in container filling machines and more particularly to an improved demountable valve mechanism for such machines.

Many fluid products are filled into cans or other rigid containers by machines having a plurality of discharge nozzles, which may be integral with valving mechanisms, equally spaced from each other on a common radius around the center of a product reservoir and extending downwardly from the reservoir's bottom, so that they may discharge into a line of containers fed into the machine below the nozzles. Valves included in such nozzle structures usually are opened by raising a container into contact with a sealing pad mounted on the lower portion of the nozzle and, by further lifting, opening a valve port to permit product to flow from the reservoir into the container.

Especially when the product is for human consumption, it is necessary that it be handled under sterile conditions. This requires that each nozzle and valve be removed daily or oftener and sterilized before reinstallation. Such removal and reassembly is very time-consuming as well as costly. Moreover, where it requires unscrewing of the nozzle from a threaded fitting it is not long before such a threaded connection becomes so worn as to require replacement.

Previous attempts to provide demountable nozzle and/or valve structures have been less than satisfactory. For example, the U.S. patent of Minard U.S. Pat. No. 3,176,731 discloses an assembly in which the locking element 40, being a loose piece, is easily bent into unusable shape or can be lost during the sterilization operation. The U.S. patent of Smith U.S. Pat. No. 3,289,712 discloses a commercial clamp for locking valves to a reservoir. As a loose part, it likewise may be mislaid when detached, is a fragile part easily damaged, and usually requires a third hand to properly join it to the reservoir.

It is the object of the present invention to provide a demountable nozzle and/or valve structure which has none of the deficiencies of such devices.

SUMMARY OF THE INVENTION

According to the present invention, each nozzle (which may include a valve) is provided with a flange which is in contact with a reservoir bottom when the nozzle is properly positioned on the machine. The flange of each nozzle is held in position on the machine by a releasable clamping device which is pivotably mounted on the machine; one such device being positioned in each of the spaces between the nozzle positions so that each clamping device engages the flanges of two nozzles and each nozzle is held in place by two clamping devices.

DESCRIPTION OF THE DRAWING

FIG. 1 is a bottom view of a portion of a filler reservoir showing two valves and nozzles in position and the clamping device in position between them in the unclamped position.

FIG. 2 is the same view with the clamping device in the clamped position.

FIG. 3 is a view in vertical section through a portion of the reservoir looking from the inside outward showing two valves and nozzles in operating position clamped to the reservoir.

FIG. 4 is a detail view in vertical section of a stop assembly.

FIG. 5 is a detail view, partially in section, showing one of the clamping devices attached to the reservoir bottom and the clamping bars extending radially from the hub.

FIG. 6 is a detail view, partially in section, showing the free end of one of the clamping bars in relation to the reservoir bottom and one of the nozzle flanges in the unclamped position of the bar.

FIG. 7 is a detail view, partially in section, of one of the clamping devices with its positioning arm contacting one of the stops.

DESCRIPTION OF THE PREFERRED EMBODIMENT

The present invention is illustrated and described herein as applied to a filling machine of the general type shown and described in the above-mentioned U.S. patent of Smith U.S. Pat. No. 3,289,712 to which reference may be had for a disclosure of details not described herein.

As best seen in FIG. 3 of the drawing, the bottom 10 of the reservoir 11 of the filling machine is provided with a even number of circular openings 12 disposed in a circular array equidistantly from the center of the circular reservoir 11. Each of a plurality of nozzles 15, which may embody valving mechanism, is provided with a boss 16 fitting closely within one of the openings 12 and a liquid tight seal between the opening 12 and boss 16 is effected by and O-ring 17. Each nozzle 15 also is provided with a flange 18 concentric therewith which, when the nozzle 15 is in operating position on the reservoir, abuts the underside of the reservoir bottom 10 and aligns the nozzle properly.

Means are provided for demountably securing each nozzle 15 in operating position on the underside of the reservoir bottom 10. This means comprises a clamping assembly 20 which includes a central hub 21 which is rockably mounted on a central shoulder screw 22 secured in the bottom 10 as by screw threads and passing through a central hole 24 which is sufficiently larger in diameter than the shoulder screw 22 to permit rocking movement of the hub 21 on the screw 22 in order to clamp a pair of nozzles. A coil spring 25 compressed between the hub 21 and the head 26 of shouldler screw 22 presses the hub 21 against the bottom 10 when the clamping assembly is in the unclamped position in which it is shown in FIG. 1.

Extending radially with respect to the axis of the hub 22 is a clamping bar 30 which is of sufficient length to underlie an edge of the adjacent flange 18 when the clamping assembly is in the clamping position in which it is shown in FIGS. 2 and 3 and thus to compress the spring 25 and clamp the flange 18 against the bottom 10. The clamping bar 30 preferably is rectangular in cross section so as to provide a larger bearing surface against the flange 18 and therefore is beveled as at 31 to facilitate its engagement over the edge of the flange 18 as the hub 21 is pivoted on the screw 22. If a clamping bar round in cross section were employed however, such beveling would be unnecessary.

In the preferred embodiment of the invention, a second clamping bar 35 extends radially with respect to the axis of the hub 21 opposite bar 30 and is of sufficient length to engage over the edge of the next adjacent flange 18 as shown in FIGS. 2 and 3. The provision of this second clamping bar stabilizes the clamping of the nozzles in operating position by clamping them at two sides and avoids any necessity for providing a plurality of clamping assemblies each associated with only a single nozzle.

Also extending radially with respect to the axis of the hub 21 is an actuating arm 37 by means of which the hub 21 may be oscillated about screw 22 within the limited arc defined by stops 39 which are positioned in the bottom 10 to limit movement of the clamping assembly clockwise as shown in FIG. 1 and counterclockwise as shown in FIG. 2. Preferably the arm 37 also is provided with an axially extending recess 40 (FIG. 7) into which a tool such as a screwdriver may be inserted to obtain greater leverage in adjusting the clamping assembly.

It will be understood that the present invention can be employed not only with various designs of filling machine valves but that it is also adaptable to use with the nozzles of piston fillers, so long as there is a flat surface adjacent the outlet orifice against which a flange such as the flange 18 may bear.

I claim:

1. In a container filling machine comprising a cylindrical reservoir provided at its bottom with a plurality of discharge openings disposed in a circular array equidistantly from the center of said reservoir and a nozzle removably fitted within each of said openings;

the improvement comprising a cylindrical flange on each of said nozzles, positioned to lie against the underside of said reservoir bottom when the nozzle is fitted within one of said discharge openings, and a series of clamping means secured to the bottom of said reservoir in a circular array equidistantly between said cylindrical flanges and operable to simultaneously engage the two adjacent flanges to hold their nozzles in position in said openings, or to simultaneously release said flanges.

2. A container filling machine according to claim 1 in which two said clamping means are engageable with the same flange at generally opposite portions thereof and each of said clamping means is engageable with two of said flanges.

3. A container filling machine according to claim 1 in which each of said clamping means comprises a central pivot pin secured to said reservoir bottom, and a clamping bar pivoted thereon is movable into positions to engage or to release an adjacent flange.

4. A container filling machine according to claim 3 in which said clamping bar is movable into positions to engage or to release two adjacent ones of said flanges.

5. A container filling machine according to claim 3 in which said pivot pin is provided with a head and said clamping bar is confined between said head and said container bottom.

6. a container filling machine according to claim 3 in which said clamping bar is connected to an actuating arm extending outwardly with respect to said reservoir.

7. A container filling machine according to claim 3 in which said clamping bar is both pivotally and rockably mounted on said pivot pin.

8. A container filling machine according to claim 5 in which a compression spring surrounds said pivot pin between the head thereof and said clamping bar.

9. A container filling machine according to claim 5 in which said clamping bar is both pivotally and rockably mounted on said pivot pin.

* * * * *